US010808890B2

(12) United States Patent
Garcia Perez

(10) Patent No.: US 10,808,890 B2
(45) Date of Patent: Oct. 20, 2020

(54) LIQUEFIED GAS TANK WITH BREAKING MEANS FOR INFLATION OF SEALED COMPARTMENTS AND BAG FOR SEALING CABLE DUCTS INCLUDED IN SAID TANK

(75) Inventor: Ignacio Garcia Perez, Benimodo (ES)

(73) Assignee: Konekt Teleco, S.L., Valencia (ES)

( * ) Notice: Subject to any disclaimer, the term of this patent is extended or adjusted under 35 U.S.C. 154(b) by 364 days.

(21) Appl. No.: 14/403,948

(22) PCT Filed: May 25, 2012

(86) PCT No.: PCT/ES2012/070385
§ 371 (c)(1),
(2), (4) Date: Jan. 12, 2016

(87) PCT Pub. No.: WO2013/175030
PCT Pub. Date: Nov. 28, 2013

(65) Prior Publication Data

US 2016/0178131 A1 Jun. 23, 2016

(51) Int. Cl.
*F17C 13/06* (2006.01)
*B63C 9/18* (2006.01)
(Continued)

(52) U.S. Cl.
CPC ..... *F17C 13/06* (2013.01); *B63C 9/18* (2013.01); *F17C 1/14* (2013.01); *F17C 5/06* (2013.01);
(Continued)

(58) Field of Classification Search
CPC ..... F17C 13/06; F17C 2270/0772; F17C 2201/0138; F17C 5/06; F17C 2201/0123; F17C 2201/0119; F17C 2201/0104
(Continued)

(56) References Cited

U.S. PATENT DOCUMENTS 2,142,012 A * 12/1938 Thompson ..... F17C 13/06 220/259.3
2,372,392 A * 3/1945 Pletman ..... B67D 1/0456 222/402.15
(Continued)

FOREIGN PATENT DOCUMENTS

EP 0757202 A2 2/1997
EP 0757203 A2 2/1997
(Continued)

*Primary Examiner* — Stephen J Castellano
(74) *Attorney, Agent, or Firm* — Gardner Linn

(57) ABSTRACT

Liquefied gas tank that is easy to machine and quick to operate and bag for sealing cable ducts incorporating said tank. The tank is provided with breaking means for inflating sealed compartments composed of a main pipe (1) closed on one side, an outlet pipe (4) inserted on the other side of the main tube through a first end (6) and closed on the distal end thereof, wherein the outlet pipe is provided with a narrowing (5) that defines a breaking point and an internal orifice (8) that extends from the first end of the outlet pipe to the narrowing (5) towards the distal end, and wherein the size of the narrowing (5), the size of the orifice (8) and the length of the outlet pipe (4) are determined such that a force applied on a lever of between 19N and 80N will break the outlet pipe (4) at the breaking point (5), releasing the gas through the orifice (8).

15 Claims, 3 Drawing Sheets

(51) Int. Cl.
*F17C 1/14* (2006.01)
*F17C 5/06* (2006.01)
*F17C 13/04* (2006.01)

(52) U.S. Cl.
CPC ..... *F17C 13/04* (2013.01); *F17C 2201/0138* (2013.01); *F17C 2223/0153* (2013.01); *F17C 2270/0772* (2013.01)

(58) Field of Classification Search
USPC ..... 220/581, 582
See application file for complete search history.

(56) References Cited

U.S. PATENT DOCUMENTS 4,103,806 A * 8/1978 White ..... B65D 83/40 220/724
5,001,013 A * 3/1991 Sturwold ..... C10M 129/26 106/14.13
5,113,912 A * 5/1992 Vetter ..... F16L 55/17 138/97
5,954,232 A * 9/1999 Shervington ..... A61M 5/3015 215/253
7,021,487 B2 * 4/2006 Kikkawa ..... B24B 31/006 216/100
2006/0148346 A1 7/2006 Summers
2009/0130933 A1 5/2009 Andrea

FOREIGN PATENT DOCUMENTS

GB 2060154 A 4/1981
WO 2012034185 A1 3/2012

* cited by examiner

A gas flow regulating element, in the form of a small rod or stud, is screwed in the orifice 8.

LIQUEFIED GAS TANK WITH BREAKING MEANS FOR INFLATION OF SEALED COMPARTMENTS AND BAG FOR SEALING CABLE DUCTS INCLUDED IN SAID TANK

RELATED APPLICATIONS

The present application is the national stage (Rule 371) of international application No. PCT/ES2012/070385 filed on May 25, 2012.

FIELD OF THE INVENTION

The present invention relates to pneumatic devices such as safety or rescue vests, sealed sheets or bags for sealing ducts, pipes, connection boxes, etc. Specifically, the invention relates to a tank containing a liquefied gas which, when the tank is opened, is released into the pneumatic device causing the expansion thereof.

BACKGROUND OF THE INVENTION

Safety or rescue vests are known which incorporate therein a gas tank or compressed air bottles allowing the auto-inflation of the vests, in order to cushion impacts in case of falls, maintain floatability, etc. However, most of these include elements attached externally to the vest itself, such as cords, carabiners, rings or the like which can break or be damaged, with the resulting risk that when these elements must be used they may not be in operative condition to fulfil their purpose.

There are also several pneumatic devices for sealing pipes, electrical lines or telephone lines by the internal expansion of a gas or liquid. Depending on the location thereof, these devices can also be used to prevent said pipes or ducts from being blocked. U.S. Pat. No. 5,131,433 describes a complex sealing device comprising a bag that can be expanded with a gas supplied by a gun with pressurised gas provided with a handle actuator mechanism. U.S. Pat. No. 5,113,912 describes a simpler mechanism composed of an inflatable ring provided with a valve, which however requires an external gas source. None of these devices can be inflated with the speed required in certain applications.

Another problem with existing tanks is that the volume of air or gas that can be introduced therein is very limited, as the pressure needed to fill the tank can be as high as 400 bar, such that these tanks are highly hazardous. The obvious solution is to increase the volume of the tank, which is not convenient in certain applications.

OBJECT OF THE INVENTION

The object of the invention is to overcome the technical problems discussed in the preceding section. For this purpose, a liquefied gas tank is provided having breaking means for the inflation of sealed compartments and consisting of a main steel pipe closed on one side, an aluminium outlet pipe inserted on the other side of the main tube on a first end and closed on the distal end, wherein the outlet pipe is provided with a narrowing that defines a breaking point and an internal orifice that extends from the first end of the outlet pipe and beyond the narrowing towards the distal end, and wherein the size of the narrowing, the size of the orifice and the length of the outlet pipe are determined such that a force between 19N and 80N will break the outlet pipe at the breaking point, releasing the gas through said orifice. Preferably, the filler gas is $CO_2$. The cross section of the main pipe can be variable. To assist filling the tank, a valve may be provided therein. The closed side of the main pipe preferably comprises a plug or ball. The outlet pipe can comprise a stop at its first end and an element for regulating the flow of liquefied gas inserted at least partially in the orifice. Since the gas is liquefied, it is possible to increase considerably the volume thereof with respect to the volume of the existing tanks, without compromising safety. Due to the breaking means, the actuation is considerably quicker than in the devices of the prior art. The invention also relate to a bag for sealing ducts for cables that comprises therein a tank according to the invention described above.

BRIEF DESCRIPTION OF THE FIGURES

To aid a better understanding of the features of the invention according to a preferred embodiment thereof, the following description of a set of drawings is accompanied where, for purposes of illustration, the following is shown.

DETAILED DESCRIPTION OF THE INVENTION

Figure 1:
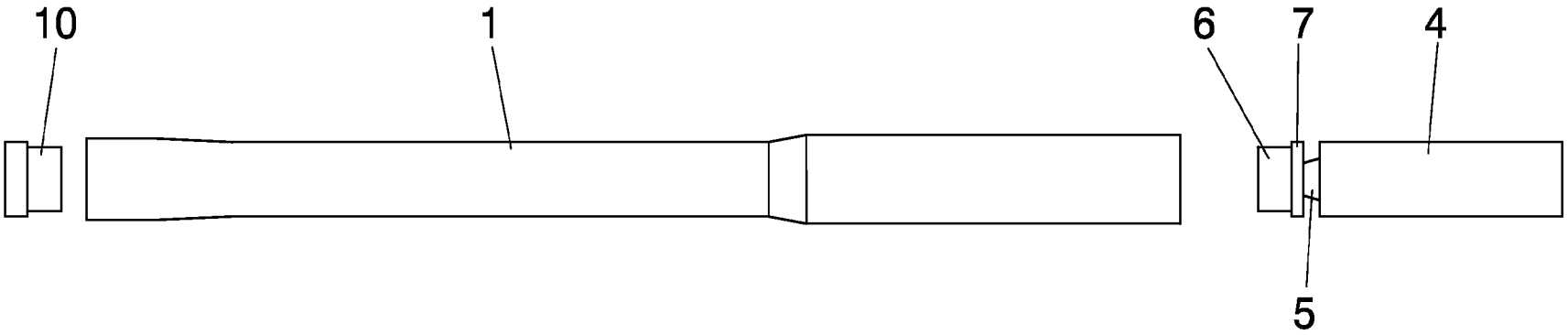
FIG. 1 is a schematic representation of the invention according to a first embodiment.

The two essential components of the invention are a main tubular element (1) and the part intended for the liquefied outlet mouth or outlet pipe (4). Both of these parts are tubular, preferably (but not necessarily) circular in cross section. The figures show how in one embodiment both parts are in a same plane. In another embodiment (not shown in the figures), one of the two parts can be curved to facilitate the breaking of the tank. The main element (1) is meant to contain a liquefied gas, such as a cooling gas, $N_2$ or preferably $CO_2$. The diameter of the pipe can change along the length thereof, defining different cross sections (2, 3). The cross sections can thus be adjusted to the volume of liquefied gas contained and the dimensions of the device that will expand. The pipe meant to house the outlet mouth (4) for the liquefied gas is closed on one end, while the other end (6) thereof has a diameter slightly smaller than that of the main element, such that the former can fit in the latter. Said end (6) can have a stop (7) and an inner orifice (8). The outlet pipe (4) has a narrowing or groove at the location of the breaking circumference or point (5).

When inserted in the main pipe, the stop prevents the narrowing from being inside the main pipe. The inner orifice (8) extends towards the closed end and can protrude slightly from the narrowing. Accordingly, when the gas is needed to expand the device to which the tank is related, it is only necessary to apply a torque on the outlet pipe (4) such that the pipe breaks at its narrowest part (5); the end of the pipe (6) will thus be inside the main pipe (1) and the orifice (8) will be free, releasing the gas through the same. The tank is opened by one of the essential features of the invention in a quick and simple manner. A person skilled in the art will recognise multiple combinations of dimensions of the narrowing, orifice and length of the outlet pipe according to the materials used, such that applying a force between 19 and 80 N (a normal force applied by a person) will easily break the tank at the breaking point.

Figure 2:
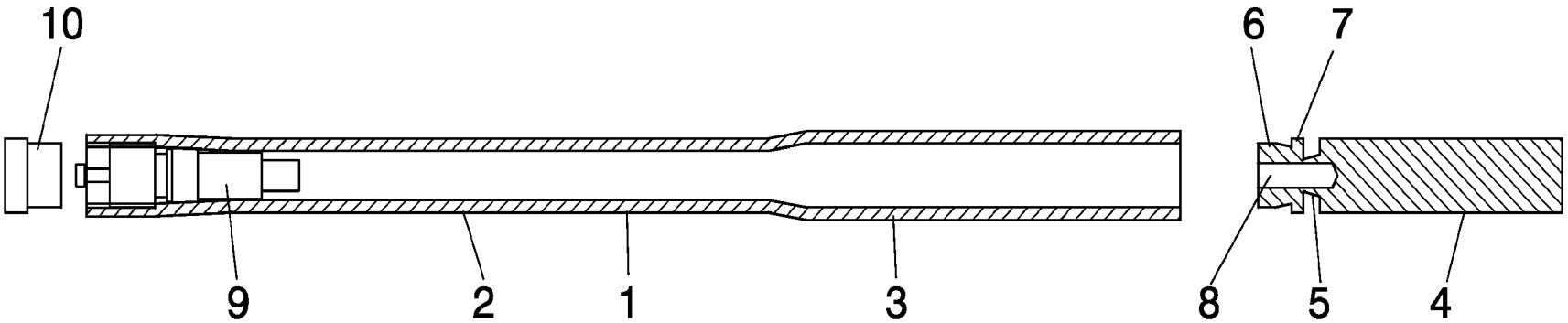
FIG. 2 is a cross sectional view of FIG. 1.
Figure 3:
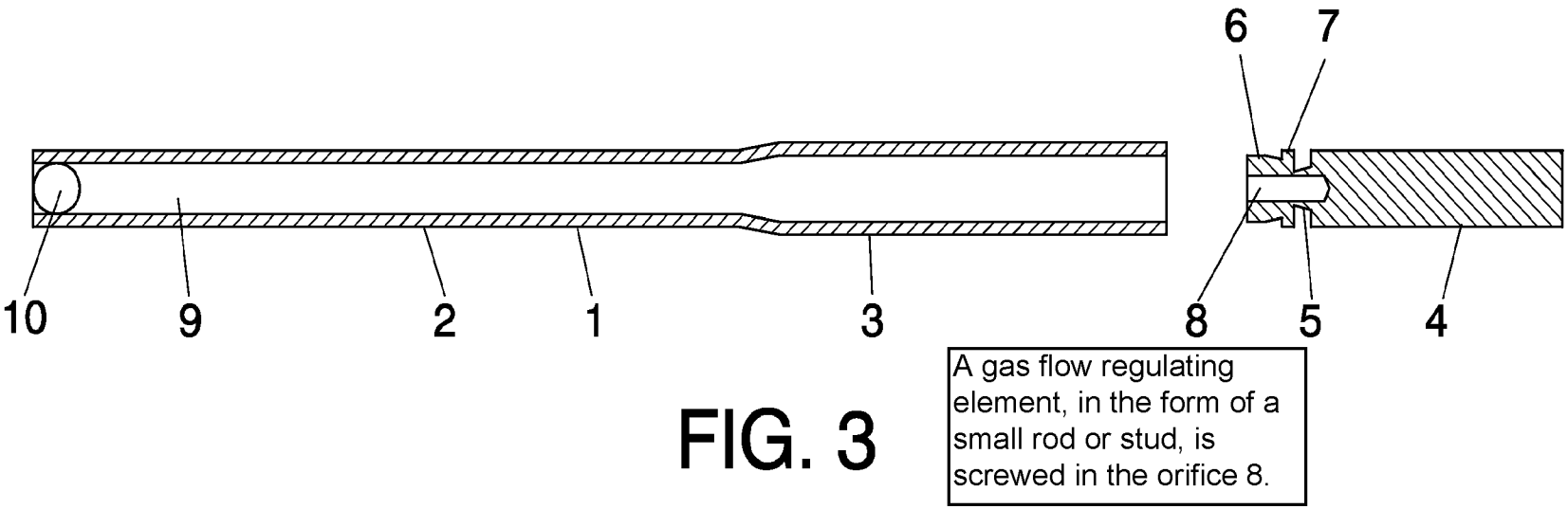
FIG. 3 is a cross-sectional view of another embodiment.
Figure 4:
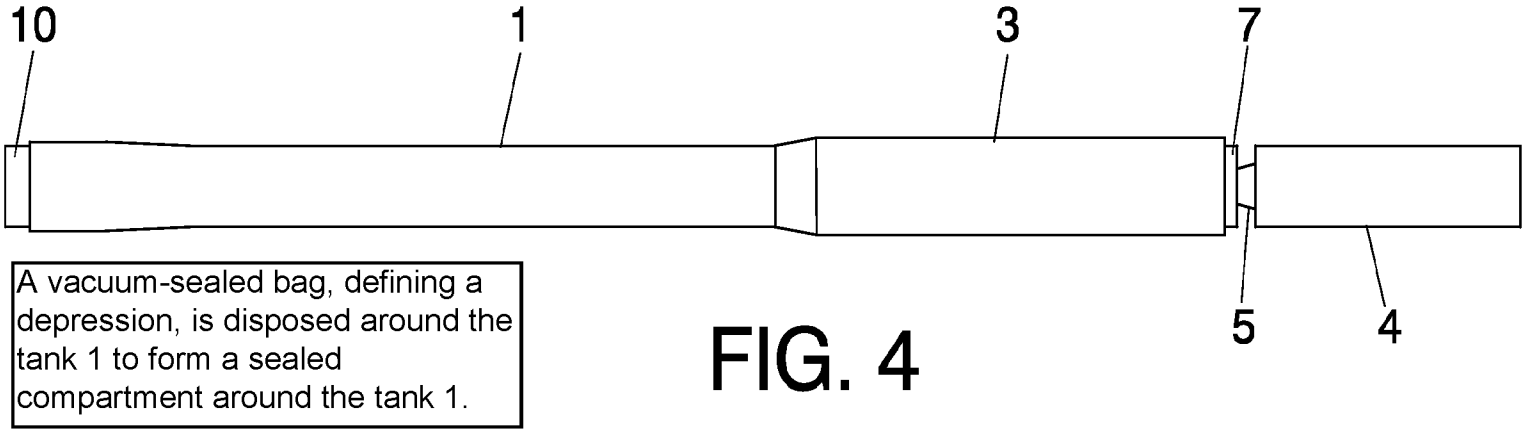
FIG. 4 shows the two basic components of the invention in an assembled position.
Figure 5:
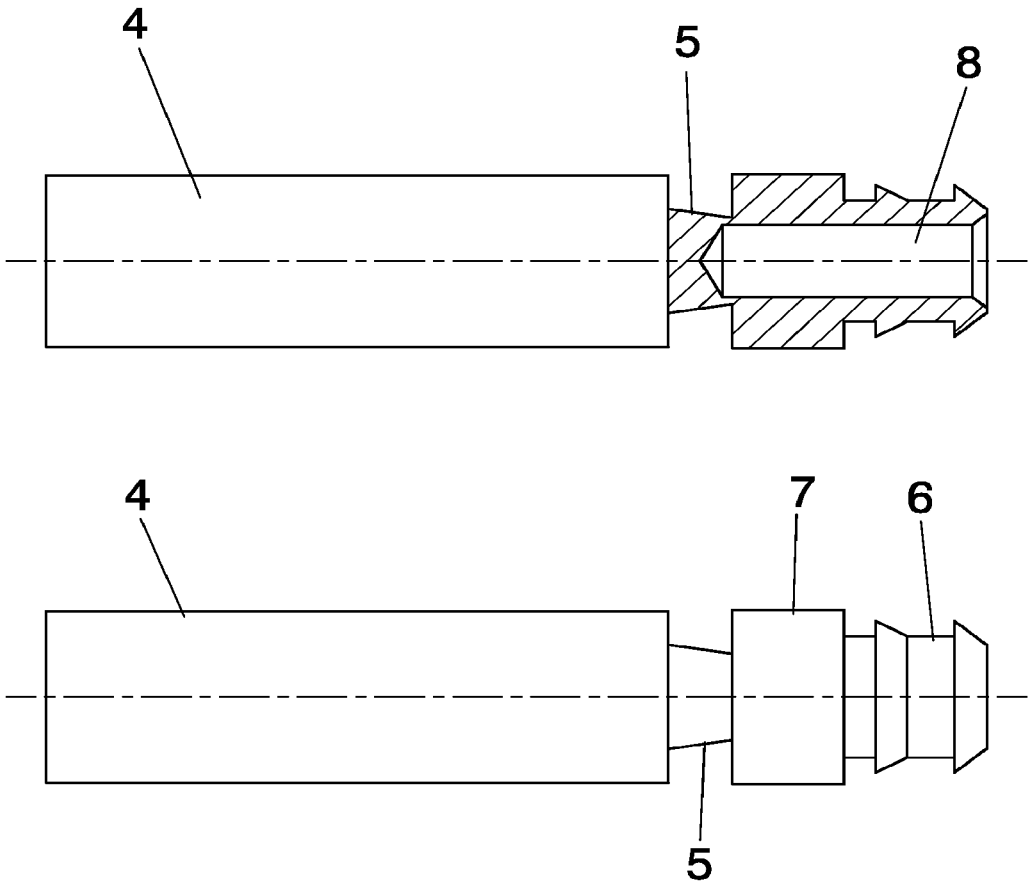
FIG. 5 shows a variation of the perimeter of the outlet pipe.

The tank can be filled with liquefied gas through a valve (FIG. 2, ref. 9) that can remain inside the tank once the latter has been sealed with a plug (10) of ball. Alternatively, the valve may not be necessary if the filling is performed using a tool external to the device allowing to inject the liquefied gas and also to insert the ball in the end of the tank, acting as a sealing plug to prevent an undesired escape of the liquefied gas at the corresponding end.

Preferably, the plug (10) and the end of the pipe (6) are inserted inside the main pipe (1) by riveting, welding or the like. Inside the orifice (8) of the outlet pipe (4) can be placed, optionally, an element to regulate the gas flow. This element can have the form of a small rod or stud, preferably screwed in the orifice (8), such that the liquefied gas is released more slowly and gradually, thereby preventing the risk of a sudden release of the gas. This element can also be formed as a pad, such as with an elliptical shape.

The main pipe is made of steel and can withstand the pressure of the filler liquefied gas, which is approximately 55 bar (steel can withstand up to 350 bar). The outlet pipe (4) is made of aluminium.

In a possible embodiment of the invention, the outlet pipe has a length of about 30 mm and a diameter slightly smaller than that of the main pipe, from 6 to 8 mm. This length and diameter provide an optimum supporting surface for breaking at the narrowing point (5), which is about 2 mm long and 2.75 mm wide. The thickness of material between the orifice and the narrowing is from 0.10 to 0.12 mm.

A particularly practical application of the tank of the invention is in bags for sealing telephone or electrical cable ducts. In this case the tank is attached inside a bag which, when vacuum-sealed, causes a depression inside said bag such that the bag houses and contains the tank without requiring additional attachment means.

During the manufacturing process of the tank the interior thereof can be impregnated with an industrial oil to prevent internal corrosion.

The tank of the invention is easy to machine and assemble as it is made with parts having simple shapes. It does not require structurally complex parts or additional elements such as cords, carabiners, rings, ring tabs or the like neither inside the sealed compartment that it is intended for nor outside the same. This prevents any damage or accidental breaking thereof that may prevent the operation of the device itself. In addition, it is very easy to assemble, streamlining the production process.

The invention claimed is:

1. A liquefied gas tank for the inflation of sealed compartments comprising:

a main pipe having opposite first and second ends and defining a tank volume filled with a liquefied gas;

an outlet pipe having an open proximal end inserted into an opening at the first end of the main pipe, and a closed distal end opposite the proximal end;

wherein the outlet pipe is provided with a narrowing region that defines a breaking point and an internal orifice that extends from the proximal end of the outlet pipe toward the distal end and through the breaking point at the narrowing region; and a stop in the form of an enlarged diameter region proximal to the narrowing region of the outlet pipe, wherein the stop diameter is larger than the opening at the first end of the main pipe such that the stop is prevented from insertion into the main pipe;

wherein the size of the narrowing, the size of the orifice and the length of the outlet pipe are determined such that a torque on the outlet pipe of between 19N and 80N will break the outlet pipe at the breaking point, releasing the gas through the orifice.

2. The liquefied gas tank according to claim 1, wherein the main pipe is made of steel and the outlet pipe is made of aluminium.

3. The liquefied gas tank according to claim 1, wherein the filler gas is $CO_2$.

4. The liquefied gas tank according to claim 1, wherein the cross section of the main pipe comprises a first constant cross section region proximate the first end and a second constant cross section region proximate the second end, wherein the first constant cross section is different from the first constant cross section.

5. The liquefied gas tank according to claim 1, wherein the main pipe or the outlet pipe is curved.

6. The liquefied gas tank according to claim 1, wherein an opening is formed at the second end of the main pipe and is configured to permit filling the tank volume of the main pipe with the liquefied gas, the gas tank further comprising a valve fitted into the opening at the second end of the main pipe.

7. The liquefied gas tank according to claim 1, wherein an opening is formed at the second end of the main pipe and is configured to permit filling the tank volume of the main pipe with the liquefied gas, the gas tank further comprising a sealing plug or ball to prevent escape of the liquefied gas.

8. The liquefied gas tank according to claim 1, further comprising an element for regulating the gas flow in the orifice.

9. The liquefied gas tank according to claim 8, wherein the gas flow regulating element comprises a rod or stud screwed in the orifice.

10. The liquefied gas tank according to claim 1, further comprising industrial oil applied to an interior of the main pipe.

11. The liquefied gas tank according to claim 1, further in combination with a bag comprising a sealed compartment for sealing cable ducts, wherein the tank is positioned inside of the bag.

12. A combination bag and liquefied gas tank for the inflation of sealed compartments comprising:

a main pipe having opposite first and second ends and defining a tank volume adapted to be filled with a liquefied gas;

an outlet pipe having an open proximal end inserted into an opening at the first end of the main pipe, and a closed distal end opposite the proximal end;

wherein the outlet pipe is provided with a narrowing region that defines a breaking point and an internal orifice that extends from the proximal end of the outlet pipe toward the distal end and through the breaking point at the narrowing region;

a stop in the form of an enlarged diameter region proximal to the narrowing region of the outlet pipe, wherein the stop diameter is larger than the opening at the first end of the main pipe such that the stop is prevented from insertion into the main pipe; and a bag comprising a sealed compartment for sealing cable ducts, wherein the bag is disposed around the tank.

13. The bag and liquefied gas tank according to claim 12, further comprising a sealing plug fitted into an opening at the second end of the main pipe and configured to prevent escape of the liquefied gas out of the tank volume.

14. The bag and liquefied gas tank according to claim 13, further comprising a valve fitted into the opening at the second end of the main pipe, inboard of the sealing plug, and configured to permit filling the tank volume of the main pipe with the liquefied gas prior to installation of the sealing plug.

15. The bag and liquefied gas tank according to claim 12, wherein the bag comprises a vacuum-sealed bag defining a depression.

* * * * *